US006279765B1

(12) United States Patent
Monaco

(10) Patent No.: US 6,279,765 B1
(45) Date of Patent: Aug. 28, 2001

(54) RAILCAR CUSHIONING DEVICE WITH INTERNAL SPRING

(75) Inventor: Jay P. Monaco, Mechanicsburg, PA (US)

(73) Assignee: ASF-Keystone, Inc., Chicago, IL (US)

( * ) Notice: Subject to any disclaimer, the term of this patent is extended or adjusted under 35 U.S.C. 154(b) by 0 days.

(21) Appl. No.: 09/009,098

(22) Filed: Jan. 20, 1998

(51) Int. Cl.[7] ..... B61G 9/02

(52) U.S. Cl. ..... 213/22; 213/29; 213/43; 213/223; 267/201; 267/207; 267/204; 267/202; 188/269

(58) Field of Search ..... 213/22, 23, 26, 213/29, 30, 31, 37–39, 33, 32 C, 32 A, 40 R, 41, 7, 8, 42, 43, 40 S, 44, 45, 65, 35, 223, 220, 221; 267/196–214, 138, 168, 134, 170, 135, 115, 207, 64.15, 221, 226, 219, 220; 188/269, 287, 286, 129, 381, 271, 315; 92/85 A, 85 B, 130 R, 130 A, 131

(56) References Cited

U.S. PATENT DOCUMENTS

| | | | |
|---|---|---|---|
| Re. 25,273 | 10/1962 | Campbell | 213/44 |
| Re. 26,472 | 10/1968 | Peterson | 213/43 |
| 1,300,404 | 4/1919 | Johnson . | |

(List continued on next page.)

FOREIGN PATENT DOCUMENTS

| | | | |
|---|---|---|---|
| 1 218 811 | 1/1971 | (BR) . | |
| 1 455 279 | 4/1969 | (DE) . | |
| 1 947 819 | 3/1971 | (DE) . | |
| 2161580 * | 7/1973 | (DE) | 267/115 |
| 0 417 594 A1 | 3/1991 | (EP) . | |
| 1 038 662 | 8/1966 | (GB) . | |
| 2 027 517 | 2/1980 | (GB) . | |

OTHER PUBLICATIONS

"Auto–Buff Cushioning Device Description".
"Auto–Gard Cushioning Device Description".
"Passive Positioning Cushioning Device Description".
"Twin–Gard Cushioning Device Description".
G. Welty, "Thrall's integral–car solution", Railway Age, Jun., 1995, pp. 53–54.

(List continued on next page.)

*Primary Examiner*—Douglas C. Butler
(74) *Attorney, Agent, or Firm*—Edward J. Brosius; Stephen J. Manich

(57) ABSTRACT

A railcar cushioning device with a gas charged cylinder and a piston contained in the cylinder for cushioning buff and draft impacts. A spring assembly is contained in the cylinder between the piston and an end of the cylinder to locate the piston in a neutral position.

42 Claims, 5 Drawing Sheets

U.S. PATENT DOCUMENTS

| | | | | |
|---|---|---|---|---|
| 1,689,662 | * | 10/1928 | Bell et al. | 213/29 |
| 1,951,114 | * | 3/1934 | Wikander | 213/29 |
| 2,184,936 | | 12/1939 | Clark | 213/46 |
| 2,444,305 | * | 6/1948 | Milhizer | 267/115 |
| 2,752,149 | * | 6/1956 | Forcellini | 267/202 |
| 2,944,681 | | 7/1960 | Blake | 213/43 |
| 3,040,907 | | 6/1962 | Pelabon | 213/43 |
| 3,047,162 | | 7/1962 | Blake | 213/8 |
| 3,135,394 | | 6/1964 | Empson | 213/43 |
| 3,139,989 | | 7/1964 | Thornhill | 213/223 |
| 3,150,781 | | 9/1964 | Housman et al. | 213/23 |
| 3,150,782 | | 9/1964 | Campbell et al. | 213/43 |
| 3,160,285 | | 12/1964 | Sinclair et al. | 213/43 |
| 3,164,262 | | 1/1965 | Price et al. | 213/8 |
| 3,173,552 | | 3/1965 | Zanow | 213/43 |
| 3,176,855 | | 4/1965 | Mulcahy et al. | 213/43 |
| 3,186,563 | | 6/1965 | Empson | 213/43 |
| 3,194,415 | | 7/1965 | Rasmussen | 213/43 |
| 3,207,324 | | 9/1965 | Blake | 213/8 |
| 3,216,592 | | 11/1965 | Peterson et al. | 213/43 |
| 3,217,897 | | 11/1965 | Peterson | 213/43 |
| 3,233,747 | | 2/1966 | Abbott et al. | 213/7 |
| 3,245,552 | | 4/1966 | Natschke | 213/46 |
| 3,249,240 | | 5/1966 | Empson | 213/43 |
| 3,251,481 | | 5/1966 | Karakashjan et al. | 213/43 |
| 3,265,222 | | 8/1966 | Goldman | 213/43 |
| 3,275,164 | | 9/1966 | Peterson | 213/43 |
| 3,399,787 | | 9/1968 | Zanow | 213/64 |
| 3,400,833 | | 9/1968 | Powell | 213/8 |
| 3,406,835 | | 10/1968 | Cook | 213/8 |
| 3,411,635 | | 11/1968 | Powell | 213/8 |
| 3,446,317 | * | 5/1969 | Gryglas | 188/315 |
| 3,447,693 | | 6/1969 | Cardwell | 213/22 |
| 3,468,433 | | 9/1969 | Peterson | 213/43 |
| 3,485,385 | | 12/1969 | Smith | 213/43 |
| 3,489,295 | | 1/1970 | Hartel | 213/8 |
| 3,493,124 | | 2/1970 | Thompson | 213/43 |
| 3,495,719 | | 2/1970 | Peppers | 213/43 |
| 3,537,598 | | 11/1970 | Moody | 213/8 |
| 3,556,311 | | 1/1971 | Kinnecom | 213/8 |
| 3,559,818 | | 2/1971 | Knippel et al. | 213/8 |
| 3,568,856 | | 3/1971 | Knippel | 213/43 |
| 3,589,527 | | 6/1971 | Seay et al. | 213/8 |
| 3,589,528 | | 6/1971 | Stephenson | 213/43 |
| 3,596,773 | | 8/1971 | Peterson | 213/8 |
| 3,596,774 | * | 8/1971 | MacCurdy | 213/8 |
| 3,598,249 | | 8/1971 | Vickerman | 213/8 |
| 3,599,802 | | 8/1971 | Knippel | 213/8 |
| 3,622,015 | | 11/1971 | Atkinson et al. | 213/46 |
| 3,651,953 | | 3/1972 | Knippel et al. | 213/43 |
| 3,682,324 | | 8/1972 | Hawthorne | 213/8 |
| 3,682,461 | * | 8/1972 | Wachenheim | 213/43 |
| 3,712,479 | | 1/1973 | Atkinson | 213/47 |
| 3,721,351 | | 3/1973 | Chierici et al. | 213/8 |
| 3,729,101 | | 4/1973 | Brambilla et al. | 213/45 |
| 3,752,329 | | 8/1973 | Seay et al. | 213/8 |
| 3,795,390 | | 3/1974 | Kendall et al. | 267/33 |
| 3,797,673 | | 3/1974 | Daugherty, Jr. | 213/8 |
| 3,800,961 | * | 4/1974 | Hawthorne | 213/8 |
| 3,806,105 | | 4/1974 | Knoishi et al. | 267/116 |
| 3,814,266 | * | 6/1974 | Hawthorne | 213/8 |
| 3,827,575 | | 8/1974 | Mosier et al. | 213/8 |
| 4,002,244 | | 1/1977 | Matsumoto et al. | 213/43 |
| 4,136,787 | * | 1/1979 | Forster et al. | 213/40 R |
| 4,262,887 | * | 4/1981 | Jansen | 267/138 |
| 4,428,565 | * | 1/1984 | Stiefel et al. | 267/207 |
| 4,505,458 | * | 3/1985 | Schultz | 213/22 |
| 5,076,451 | | 12/1991 | Conley et al. | 213/43 |
| 5,104,101 | | 4/1992 | Anderson et al. | 267/219 |
| 5,487,480 | | 1/1996 | Page et al. | 213/43 |
| 5,642,823 | | 7/1997 | Kalina et al. | 213/43 |
| 5,676,265 | | 10/1997 | Miller | 213/49 |
| 5,746,335 | * | 5/1998 | Brough et al. | 213/43 |
| 5,845,796 | * | 12/1998 | Miller | 213/43 |
| 5,927,523 | * | 7/1999 | Huggins et al. | 213/223 |

OTHER PUBLICATIONS

Thrall Car, "Unlock the Future of vehicle transportation with the UniversalCar. ™", Railway Age, Jun., 1995, pp. 78–79.

Thrall Car, "UniversalCar™ Designed and Built by Thrall Car", 1995.

TTX Engineering and Research Newsletter, vol. 2, No. 2, 2$^{nd}$ Quarter 1995, p. 4.

Nov. 3, 1997 correspondence with proposed AAR Specification, written by Jay P. Monaco to Chairman of the AAR Cushioning Device Task Force.

Proposed specification M–921E, Nov., 1997.

R. Hodges, FM Industries, Description of 10"–2" Active Draft Cushioning Device, dated Nov., 7, 1997, distributed to meeting attendees on Jan. 6, 1998.

R. Hodges, FM Industries, Description of 8¾"–1¼" Active Draft Cushioning Device, dated Nov. 7, 1997, distributed to meeting attendees on Jan. 6, 1998.

Facsimile message re Additional 10–2 EOCC Description, sent Nov. 10, 1997, distributed to meeting attendees Jan. 6, 1998.

F. Andrew Nibouar, Nov. 10, 1997 Letter with attachments.

AAR Cushioning Device Task Force Docket, Jan. 6, 1998 (Open Docket Item 1.B.).

U.S. Pat. App. Ser. No. 08/843,014, filed Apr. 11, 1997 by J. Monaco, J. Pershets, and M. Scott.

Form PTO 850 dated May 31, 1999, pp. 1–54 re U.S. Pat. App. Ser. No. 08/843,014.

Notice Declaring Interference mailed Sep. 30, 1999 re U.S. Pat. App. Ser. No. 08/843,014.

Abandonment of Contest in Interference re U.S. Pat. App. Ser. No. 08/843,014.

Judgement in Interference mailed Apr. 11, 2000 re U.S. Pat. App. Ser. No. 08/843,014.

American Hydraulics, Inc., "New! From American Hydraulics, Inc. *Positive Buff and Draft Cushioning Devices M–921E*", undated copy of single sheet card stock distributed at Sep., 1998 Railway Supply Trade Show.

American Hydraulics, Inc., "Rail Car America American Hydraulics, Inc. Active Unit New Specification M–921E", undated copy of booklet distributed at Sep., 1998 Railway Supply Trade Show, pp. 14–16.

American Hydraulics, Inc. Drawing MA–05–1294.

* cited by examiner

RAILCAR CUSHIONING DEVICE WITH INTERNAL SPRING

FIELD OF THE INVENTION

The invention relates generally to railway car cushioning devices of the type having a hydraulic shock absorber which is moved from a neutral position for absorbing both buff and draft impacts.

BACKGROUND OF THE INVENTION

Cushioning devices are used to protect railcars and lading from impacts during coupling and train action events. To absorb the high forces caused by these impacts, cushioning devices are employed between the frame of the railcar and couplers.

Impacts applied to railcars result in high forces applied to the coupler in both the buff direction and the draft direction. "Buff" is a term in the rail industry used to describe the movement experienced by the coupler when it is moved towards its associated railcar. "Draft" is a term in the rail industry used to describe the movement experienced by the coupler when it is moved away from its associated railcar. A buff impact moves the coupler towards its associated railcar. A draft impact moves the coupler away from its associated railcar.

Conventionally railcar impacts are cushioned by hydraulic cylinders. In one type of hydraulic cylinder, pressurized gas in hydraulic fluid in the cylinder biases the piston to a fully extended position. If a draft impact occurs while the piston is fully extended, the device is unable to cushion the impact because the piston cannot move further in draft. In another type of gas charged hydraulic cushioning device, an externally mounted spring prevents the pressurized hydraulic fluid from fully extending the piston and holds the piston in a neutral position. The piston can move from the neutral position in response to either buff or draft impacts. The external spring increases the size of the cushioning device and makes installation difficult. The external spring is exposed to dirt and other environmental contaminants that can adversely affect operation of the cushioning device. The restoring force generated by the external spring acts along a line of force eccentric with the line of action of the cylinder itself, and may cause uneven or accelerated wear of moving components.

Thus, there is a need for an improved gas charged hydraulic railcar cushioning device that can cushion both buff impacts and draft impacts without an external spring device, and has forces applied along the line of action of the cushioning device itself.

SUMMARY OF THE INVENTION

The present invention is an improved railcar cushioning device that is responsive from a neutral position for absorbing buff and draft impacts. The cushioning device includes a hydraulic cylinder charged with pressurized hydraulic fluid. A piston in the cylinder is connected to a piston rod extending out of the cylinder through a front head. The hydraulic fluid urges the piston towards the front head of the cylinder. A spring assembly in the cylinder includes a spring confined between the piston and the front head of the cylinder. The spring surrounds the piston rod. The pressurized fluid holds the piston against the spring in a neutral position spaced inwardly from the front head of the cylinder.

In the preferred embodiment of the present invention, the spring is a friction or ring spring having a plurality of interfitted circular rings with engaged conical friction surfaces. During a draft impact, the rings are stressed and slide against one another. Impact energy is stored and dissipated. The improved railcar cushioning device allows hydraulic cushioning of buff impacts and combined hydraulic and mechanical cushioning of draft impacts.

Other objects and features of the invention will become apparent as the description proceeds, especially when taken in conjunction with the accompanying drawings illustrating three embodiments of the invention, of which there are five sheets.

DETAILED DESCRIPTION OF THE PREFERRED EMBODIMENT

Figure 1:
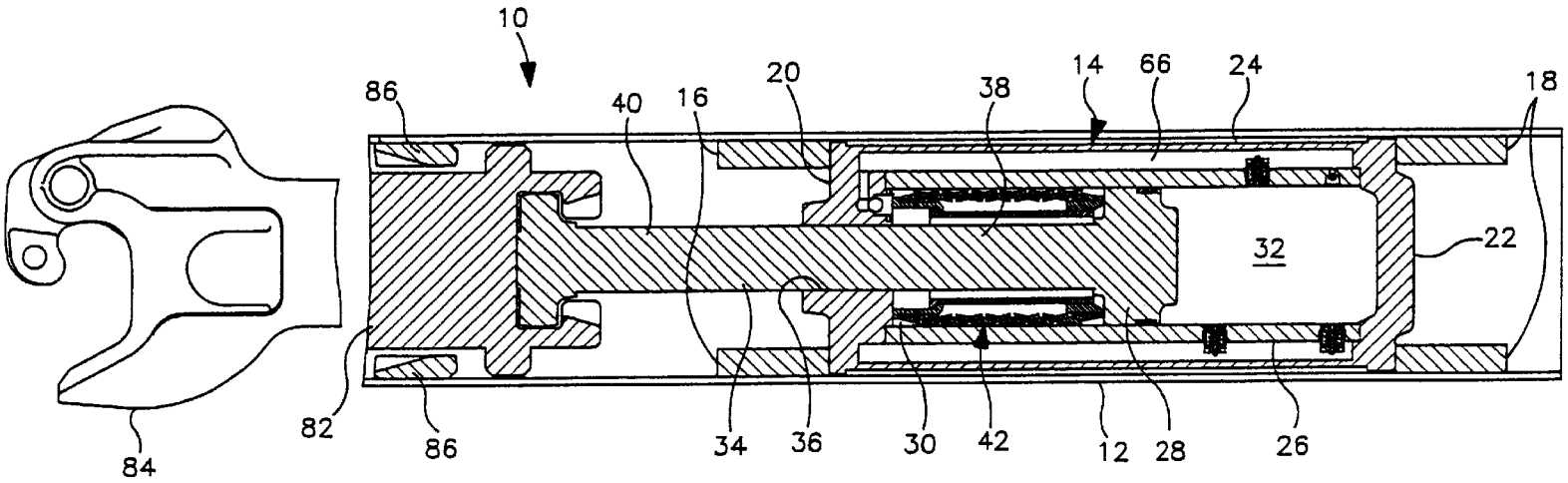
FIG. 1 is a horizontal sectional view illustrating a railcar cushioning device constructed in accordance with this invention and shown in the neutral position.

FIGS. 1–6 illustrate a railcar cushioning device 10 installed in the center sill 12 of a railcar (not illustrated) Cushioning device 10 includes a cylinder housing 14 mounted in sill 12 between spaced pairs of stops 16 and 18. Cylinder housing 14 includes a front head 20, a rear head 22, and outer cylindrical wall 24 and interior cylindrical pressure wall 26 extending between the heads. Piston 28 in wall 26 carries a seal ring which engages the interior surface of inner wall 26 and divides the space within wall 26 into front cylindrical chamber 30 and rear cylindrical chamber 32. The seal ring prevents leakage of hydraulic fluid past the piston. Piston rod 34 extends from piston 28 out of cylinder housing 14 through bore or rod passage 36 in front head 20. Front head 20 divides piston rod 34 into an interior piston rod segment 38 located within front chamber 30 and an exterior piston rod segment 40 located outside of front chamber 30. A suitable seal is provided in the bore to prevent leakage of hydraulic fluid from the cylinder housing.

Figure 6:
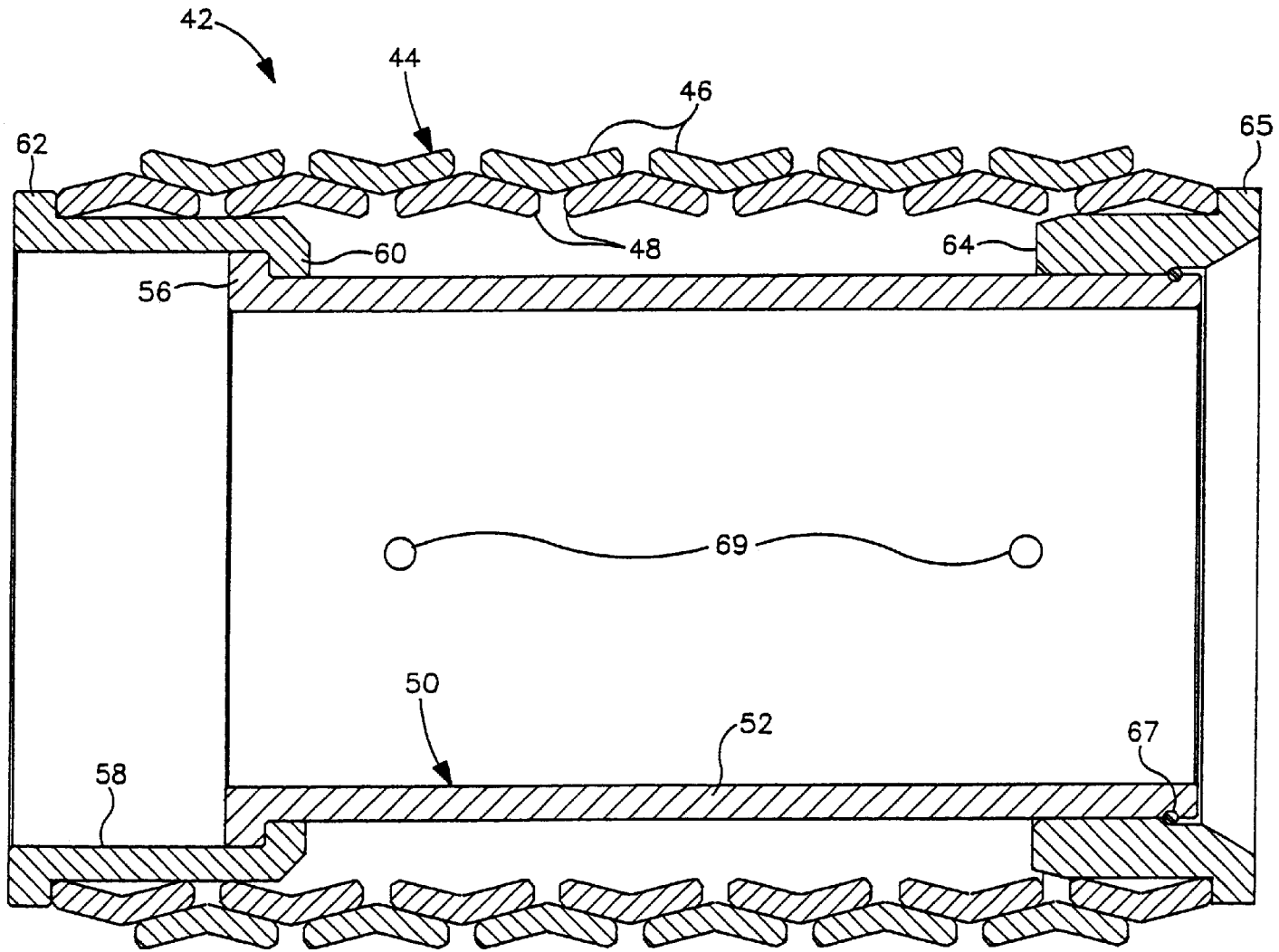
FIG. 6 is a sectional view of the spring assembly of the cushioning device shown in FIG. 1.

Spring assembly 42 is located in front chamber 30 between piston 28 and head 20. As illustrated in FIG. 6, assembly 42 includes a ring spring 44 having a set of engaged inner and outer rings or hoops 46 and 48. A keeper 50 holds rings 46 and 48 together as illustrated. Keeper 50 includes an elongate sleeve 52 with a circumferential stop member or end flange 56 extending outwardly from the lefthand end of the sleeve as shown in FIG. 6. Collapsible sleeve 58 is slidably mounted on flange 56 and includes an interior circumferential stop member or flange 60 extending inwardly behind flange 56 to hold the two sleeves together while permitting relative movement of the sleeves to the collapsed position shown in FIG. 4. Radially outwardly extending circumferential flange 62 is provided on the free end of sleeve 58 and engages the ring 48 at one end of spring 44. Cylindrical spring retainer 64 is mounted on the end of sleeve 52 away from sleeve 58 and includes an outwardly extending circumferential flange 65 which engages the spring ring 48 at the adjacent end of spring 44. Retention ring 67 holds retainer 64 on sleeve 52 with spring 44 under a desired preload compression and with the rings 46 and 48 engaging each other, as illustrated. Bores 69 in sleeve 52 communicate the annular space between the sleeve and the spring 44 and permit flow of hydraulic fluid from and to the space as the spring is collapsed and expands and the volume of the space changes.

Figure 7:
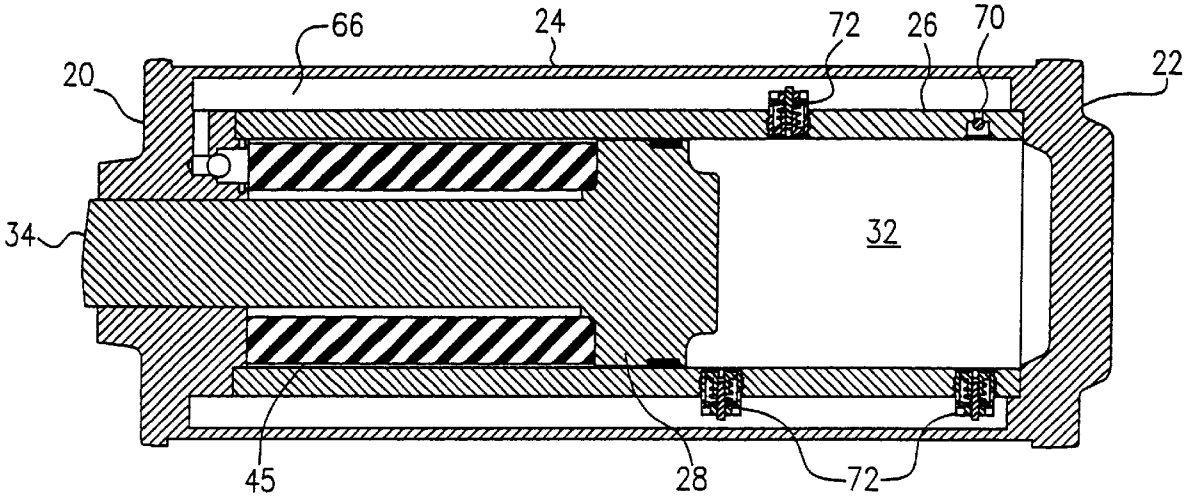
FIG. 7 is a similar of FIG. 3 but illustrates a second embodiment cushioning device having an elastomeric spring.
Figure 8:
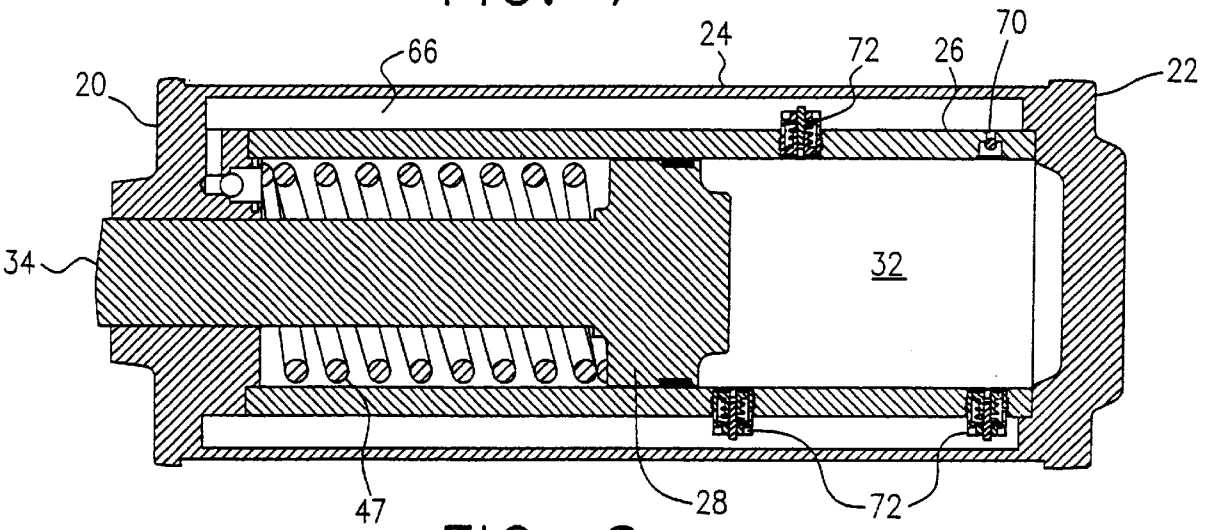
FIG. 8 is similar to FIG. 3 but illustrates a third embodiment cushioning device having a metal coil spring.

Ring spring 44 has a close sliding fit within the inner cylindrical pressure wall 26 to locate the ends of the spring in place for engagement between piston 28 and front head 30 as shown in the drawings. The outer diameter of spring 44 is slightly less than the inner diameter of wall 26. The close fit between the ring spring 44 and pressure wall 26 permits use of large diameter rings 46 and 48 for improved cushioning and reduction in length of housing 14. The assembly is free to move axially along the pressure wall 26. If desired, one end of the assembly may be secured to either the front head 20 or piston 28 without altering operation of the cushioning device. If desired, ring spring 44 may be replaced by other types of springs including elastomer and metal coil springs. FIG. 7 illustrates a second embodiment cushioning device having an elastomeric spring 45. FIG. 8 illustrates a third embodiment cushioning device having a metal helical coil spring 47.

The spring assembly inner sleeve 52 is spaced outwardly from piston rod 34. If desired, the spring assembly 42 may be slidably mounted on the interior segment 38 of piston rod 34. In such case, plastic bearings may be provided between sleeve 52 and the piston rod.

Figure 3:
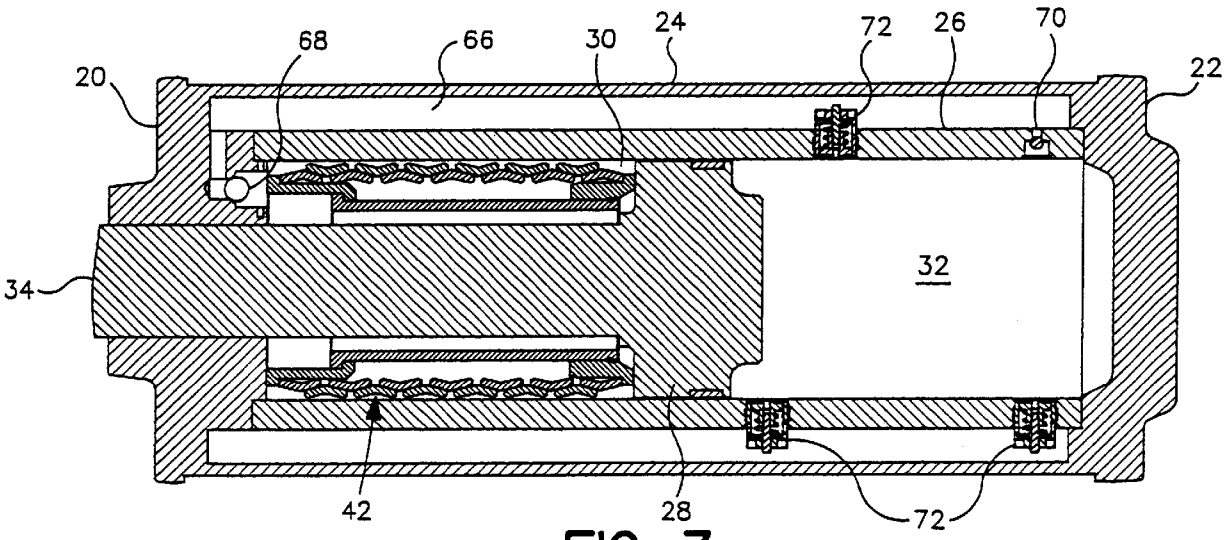
FIG. 3 is an enlarged view of the cushioning device of FIG. 1 shown in the neutral position.
Figure 4:
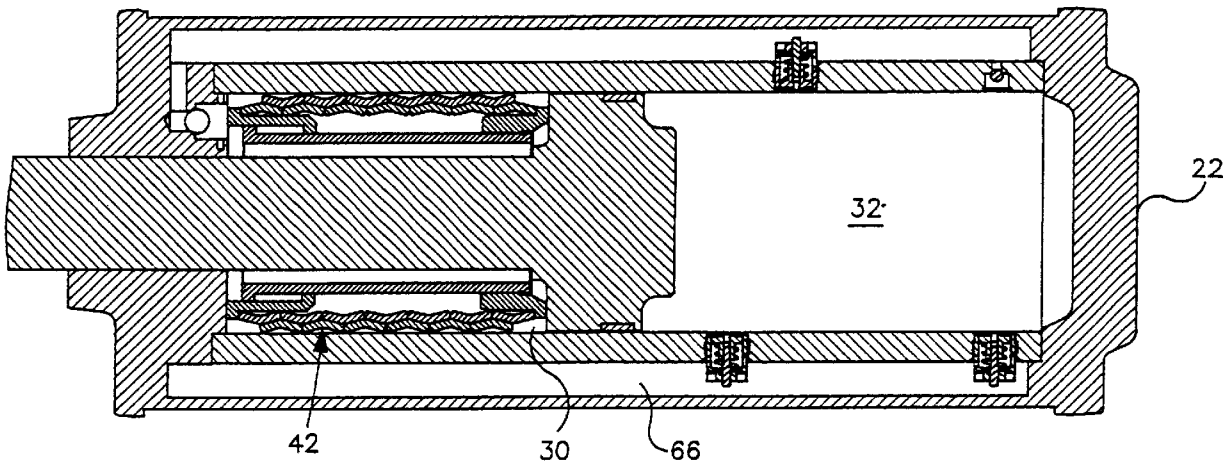
FIG. 4 is an enlarged view of the cushioning device of FIG. 1 shown collapsed in a draft direction from the neutral position.

Walls 24 and 26 define annular storage chamber or reservoir 66 extending between heads 20 and 22. One way ball valves 68 and 70 at the ends of reservoir 66 permit flow of hydraulic fluid from chamber 66 into chambers 30 and 32, respectively, while preventing flow from chambers 30 and 32 into the reservoir. FIGS. 1 and 3 illustrate cushioning device 10 with piston 28 located in a neutral position. Buff impacts move the piston from the neutral position along a relatively long stroke toward the rear head 22. Draft impacts move the piston from the neutral position along a relatively short stroke toward the front head 20. The compressed hydraulic fluid in the interior chambers of cushioning device 10 biases the piston toward the front head and into engagement with the fully extended stiff spring assembly 42, as shown in FIG. 4, to maintain piston 28 in the neutral position so that the device may receive and cushion both buff and draft impacts.

During buff impacts hydraulic fluid in chamber 32 flows outwardly of the chamber through a number of small diameter apertures or spring backed flow control valves 72 extending through the pressure wall 26 and communicating chambers 32 and 66. Apertures or valves 72 are located on the pressure wall as required to cushion buff impacts properly. The spacing and number of apertures or valves 72 are not critical to the present invention.

Figure 2:
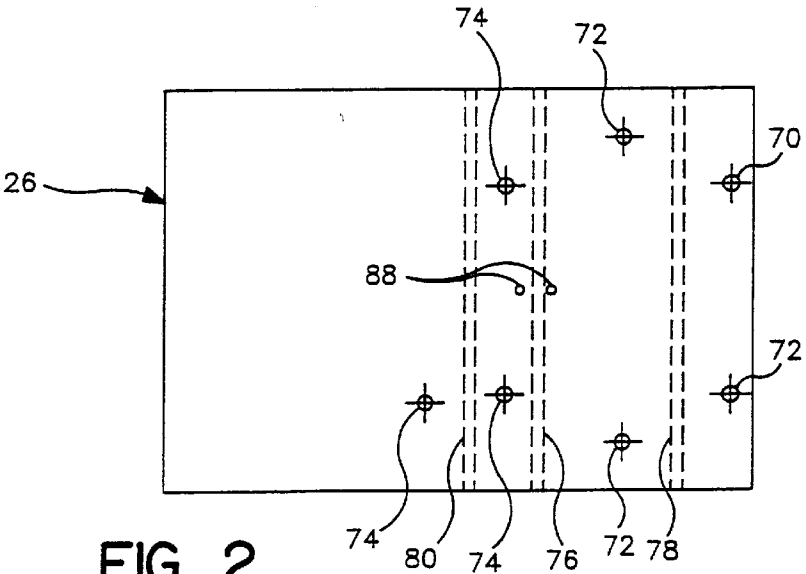
FIG. 2 is a schematic illustration of the ports in the pressure cylinder wall of the cushioning device of FIG. 1, showing the wall unwound.

A number of small diameter apertures or spring backed flow valves 74 extend through wall 26 and communicate front chamber 30 and reservoir 66, as illustrated in FIG. 2. In this figure, lines 76 illustrate the position of the sealing ring on piston 28 when the piston is in the neutral position, lines 78 indicate the position of the ring when the piston is in the full buff position and lines 80 indicate the position of the ring when the piston is in the full draft position. The spacing and number of apertures or valves 74 are not critical to the present invention.

Small flow apertures 88, shown in FIG. 2, extend through pressure wall 26 to either side of lines 76 to communicate chambers 30 and 32 with reservoir 66. The apertures 88 allow flow of hydraulic fluid from front chamber 30 into the reservoir during return of the piston to the neutral position following a buff impact and flow from the rear chamber 32 to the reservoir during return of the piston to the neutral position following a draft impact.

Piston rod segment 40 is connected to yoke 82 and in turn to coupler 84 pivotally mounted on the yoke. Yoke 82 is slidably mounted on sill 12 between buff stops 16 and draft stops 86 for limiting movement in buff and draft directions.

Chambers 30 and 32, and reservoir 66 are charged with pressurized hydraulic fluid using conventional hydraulic oil and gas filling ports (not illustrated) provided in housing 14. When the gas and hydraulic oil are separated, the oil fills chambers 30 and 32 and partially fills reservoir 66. The gas fills the remainder of reservoir 66.

Between impacts piston 28 is in the neutral position shown in FIG. 1. Internal hydraulic fluid pressure holds piston 28 against stiff spring assembly 42. The preload of spring 42 is selected to be greater than the force exerted by the internal hydraulic fluid pressure against piston 28 to establish the neutral position.

Figure 5:
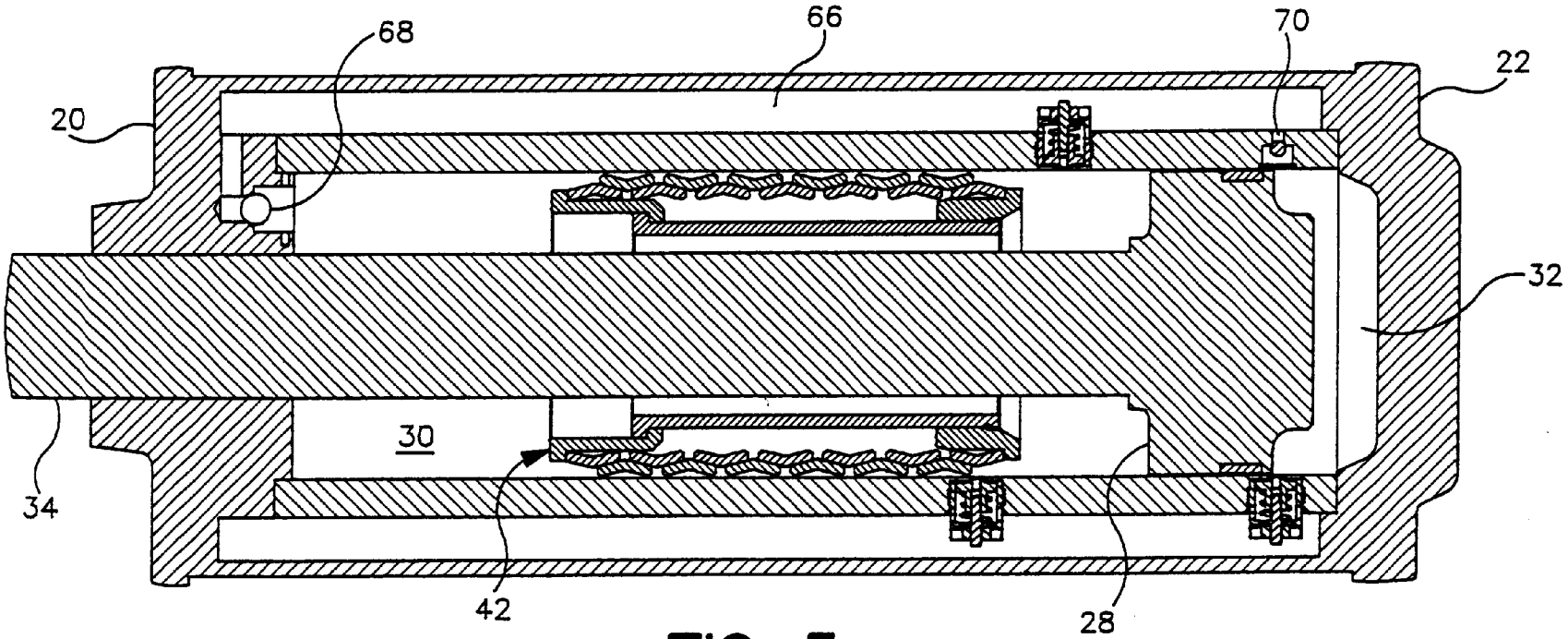
FIG. 5 is an enlarged view of the cushioning device of FIG. 1 shown collapsed in a buff direction from the neutral position.

Upon a buff impact sufficient to open the valves 72 (if provided), hydraulic fluid flows from chamber 32 into reservoir 66 as piston 28 moves from the neutral position towards the rear head 22 to cushion the impact hydraulically. FIG. 5 illustrates piston 28 fully displaced in a buff direction from the neutral position. Hydraulic fluid also flows from reservoir 66 to front chamber 30 through one-way valve 68.

Spring assembly 42 is free to slide along wall 26 during buff movement of the piston. As shown in FIG. 5, spring assembly 42 can slide to an intermediate position between piston 28 and front head 20. The spring assembly is not compressed during the buff action and only the hydraulic resistance of cushioning device 10 cushions the buff impact. After buff impact, cushioning device 10 is returned to the neutral position by the pressurized hydraulic fluid.

Upon a draft impact sufficient to overcome the preload of spring assembly 42 and open valves 74, (if provided), piston 28 moves from the neutral position towards the front head 20. FIG. 4 illustrates piston 28 fully displaced in a draft direction from the neutral position. During draft collapse of the device 10, one-way valve 68 closes to prevent hydraulic fluid flow from front chamber 30 into reservoir 66. As piston 28 moves in the draft direction, hydraulic fluid in front chamber 30 is flowed into the reservoir to provide hydraulic cushioning of the draft impact.

Simultaneously with the hydraulic cushioning of the draft impact, piston 28 collapses spring assembly 42 against front head 20. Sleeve 58 is held against front head 20 while piston 28 pushes spring retainer 64 towards the front head 20 to compress the ring spring 44 between flanges 62, 65. Compression of ring spring 44 causes relative sliding of rings 46 with respect to rings 48 generating frictional and stress forces that absorb and dissipate impact energy. Rings 46 expand and rings 48 contract with compression of the ring spring and elastically absorb impact energy. Heat generated during compression of the ring spring is dissipated in the hydraulic fluid. Spring 44 acts on the axis of rod 34 and does not subject the rod to eccentric loadings.

After a draft impact, cushioning device 10 is restored to the neutral position by the spring assembly. Elastic energy stored in ring spring 44 during compression pushes piston 28 toward rear head 22 until flanges 56 and 60 reengage to return the piston to the neutral position. As ring spring 44 extends from its compressed position, rings 46 and 48 again slide against one another to convert stored energy to heat, which is dissipated.

The piston rod of the disclosed cushioning device is attached to the yoke for relative draft and buff movement with the cylinder stationarily mounted on the railcar sill. Alternatively, the piston rod can be mounted on the railcar and the cylinder can be attached to the yoke for relative draft and buff movement with the yoke. The large diameter rings or hoops 46 and 48 in ring spring 44 have a diameter slightly less then the interior diameter of pressure wall 26. Use of large diameter rings permits maximum deflection per ring during collapse of the spring and consequently reduces the length of the ring spring. Reduction of the length of the ring spring means that the distance between the front and rear heads in housing 14 may be advantageously minimized.

The improved railcar cushioning device has significant advantages over conventional railcar cushioning devices. Location of the spring assembly in the hydraulic cylinder provides a compact cushioning device which is easily installed and uses minimum sill length on new and existing railcars. The spring assembly is protected from external contamination and is permanently lubricated by the hydraulic fluid in the cylinder itself. The piston rod extends through the spring assembly so that the force applied by the spring assembly is in line with the line of action of the cushioning device itself. The ring spring is very stiff and has a high spring rate, allowing a high preload force if desired and permitting the improved cushioning device to generate a large force opposing draft movement with a short draft stroke. During the draft stroke the rings of the ring spring slide against one another to dissipate impact energy by friction and increase the ability of the cushioning device to cushion a draft impact.

While I have illustrated and described a preferred embodiment of my invention, it is understood that this is capable of modification, and I therefore do not wish to be limited to the precise details set forth, but desire to avail ourselves of such changes and alternations as fall within the purview of the following claims.

What I claim as my invention is:

1. A railcar cushioning device comprising a cylinder having a first end and a second end, pressurized hydraulic fluid in said cylinder for cushioning buff and draft impacts; a piston carried in said cylinder; a piston rod extending from said piston sealingly through said first end of said cylinder, said hydraulic fluid urging said piston toward said first end of said cylinder; one of said piston rod and said cylinder configured to be secured stationarily to a railcar and the other of said piston rod and said cylinder configured to be secured to a coupling for coupling to an adjacent railcar; and a friction device in said cylinder between said piston and one of said ends to limit movement of said piston toward said first end of said cylinder, said friction device including a first friction surface and a second friction surface engaging said first surface, said first surface moving along said second surface as said piston moves toward said first end of said cylinder; a keeper comprising a pair of axially spaced contact surfaces, one contact surface contacting one part of the friction device and the other contact surface contacting another part of the friction device, said keeper contact surfaces having a maximum axial spacing and the axial spacing between the keeper contact surfaces decreasing when the piston moves toward the first end of said cylinder in response to a draft impact of sufficient magnitude, said keeper contact surfaces being distinct from the piston, piston rod, cylinder and friction device.

2. The railcar cushioning device as in claim 1 including a spring in the cylinder.

3. The railcar cushioning device as in claim 2 wherein said friction device includes a ring spring having a plurality of rings, said first and second surfaces are located on said rings, and said rings surround the piston rod.

4. The railcar cushioning device as in claim 3 wherein said keeper comprises a spring keeper.

5. The railcar cushioning device as in claim 4 wherein the keeper is collapsible.

6. The railcar cushioning device as in claim 5 wherein the spring is preloaded in the keeper.

7. The railcar cushioning device as in claim 3 wherein the rings are slightly smaller than the cylinder.

8. The railcar cushioning device as in claim 1 wherein said friction device surrounds the piston rod.

9. A railcar cushioning device for cushioning both buff and draft impacts, said cushioning device comprising:

a cylinder having a first head at one cylinder end, a second head at an opposed cylinder end, said cylinder and heads defining an interior chamber extending along the length of the cylinder;

a piston located in said chamber and sealingly engaging said cylinder, the piston dividing said chamber into a first chamber portion adjacent said first head and a second chamber portion adjacent said second head and movable along the cylinder between said heads;

a piston rod joining the piston and extending from the piston through the first head to a piston rod end, said piston and said piston rod being axially movable;

pressurized hydraulic fluid in said cylinder chamber urging said piston toward said first head;

a spring in said first chamber portion, said spring surrounding said piston rod, said pressurized hydraulic fluid normally holding said piston against the spring in a neutral position in the chamber, the neutral position spaced between said first and second heads;

said piston having a first energy absorbing stroke extending from the neutral position a distance along the cylinder toward the first head and a second energy absorbing stroke extending from the neutral position a distance along the cylinder toward the second head;

a radial contact surface in the first chamber portion contacting part of the spring between the piston and the first head, the radial contact surface being distinct from the piston rod and the first head of the cylinder, at least part of the spring being between the piston and the radial contact surface.

10. The railcar cushioning device of claim 9 wherein said spring comprises an elastomer spring.

11. The railcar cushioning device of claim 9 wherein said spring comprises a metal spring.

12. The railcar cushioning device of claim 9 wherein said spring engages the piston and the first head when the piston is in the neutral position.

13. The railcar cushioning device of claim 9 wherein said spring includes a plurality of annular members surrounding the piston rod and spaced along the piston rod.

14. The railcar cushioning device of claim 13 wherein said annular members comprise metal rings having mutually engageable friction surfaces.

15. The railcar cushioning device of claim 9 including a spring keeper for preloading the spring; said spring keeper having opposed first and second spring keeper ends and a tension member extending between such ends, said spring located between such ends, one of said spring keeper ends including said radial contact surface.

16. The railcar cushioning device of claim 15 wherein said tension member includes two parts and is collapsible.

17. The railcar cushioning device of claim 16 wherein said tension member includes a pair of overlapping sleeves surrounding the piston rod, and a stop member on each sleeve, said stop members engaging each other when the spring keeper is extended.

18. The railcar cushioning device of claim 17 wherein said spring includes a plurality of annular members.

19. The railcar cushioning device of claim 18 wherein the annular members comprise metal rings.

20. The railcar cushioning device of claim 9 including a hydraulic fluid reservoir surrounding the cylinder and hydraulic fluid flow passages communicating the chamber and reservoir.

21. The railcar cushioning device of claim 9 wherein said first energy absorbing stroke is shorter than said second energy absorbing stroke.

22. The railcar cushioning device of claim 9 wherein said spring is movable away from at least one of said front head and piston.

23. The railcar cushioning device of claim 9 wherein said spring is freely movable along the piston rod away from the front head and away from the piston.

24. The railcar cushioning device of claim 9 including a spring keeper, said spring keeper further including an elongate sleeve located between the spring and the piston rod and including end members engaging the ends of the spring, at least one of said end members being axially movable with respect to the elongate sleeve, one of said end members including said radial contact surface, said keeper compressing said spring when the piston is in the neutral position.

25. The railcar cushioning device of claim 24 wherein said spring comprises a plurality of metal rings having interengageable friction surfaces.

26. A railcar cushioning device comprising a cylinder having a first end and a second end, pressurized fluid in the cylinder, a piston in said cylinder, a piston rod extending from said piston sealingly through said first end of said cylinder, said hydraulic fluid urging said piston toward said first end of said cylinder, and a spring in said cylinder extending along the piston rod, said spring normally locating the piston in a neutral position between said first and second cylinder ends, said spring having an axial dimension, said piston movable from the neutral position towards each of said first and second cylinder ends along energy absorption strokes, said cushioning device further including an annular element in the cylinder, the annular element having a contact surface in contact with at least part of the spring, at least part of said contact surface being radially spaced from the piston rod, said annular element being distinct from the cylinder and having a maximum axial dimension substantially less than the distance between the piston and the nearest cylinder end when the piston is in the neutral position.

27. The device of claim 26 including a spring keeper, said spring keeper preloading the spring when the piston is in the neutral position, said annular element comprising part of said spring keeper.

28. The device of claim 27 wherein said annular element comprises a spring retainer, said keeper further comprising an elongate annular sleeve positioned radially inward from the collapsible spring retainer and outward of the piston rod and a collapsible sleeve positioned radially outward from the elongate annular sleeve and axially spaced from the spring retainer, said keeper extending from the piston to the nearest cylinder end when the piston is in the neutral position.

29. The device of claim 26 wherein the spring includes a plurality of metal rings, each said ring having an outer diameter slightly smaller than the interior diameter of the cylinder.

30. The device of claim 28 wherein the maximum axial dimension of said annular element is less than half the distance between the piston and the nearest cylinder end when the piston is in the neutral position.

31. The device of claim 26 wherein the spring is located between the piston and the first cylinder end.

32. The device of claim 26 wherein the spring surrounds the piston rod and has a maximum outer diameter and a minimum outer diameter, the contact surface of the annular element contacting the spring at the minimum outer diameter of the spring.

33. A railcar cushioning device comprising a cylinder having a first end and a second end; a reservoir; flow passages communicating the cylinder and reservoir; pressurized hydraulic fluid in the cylinder and reservoir; a piston in the cylinder; a piston rod extending from said piston through the first end of the cylinder; said piston movable along the cylinder from a neutral position located between said cylinder ends toward each cylinder end in response to buff and draft impacts; and a spring in said cylinder located between said piston and one end of said cylinder to hold the piston in the neutral position against the pressure of the hydraulic fluid; a contact surface in contact with at least part of the spring, said contact surface being in the cylinder between one end of the cylinder and the piston, said contact surface being axially spaced from the piston, distinct from the cylinder, and including a portion that is radially spaced from the piston rod, at least part of the spring lying between the contact surface and the piston; said spring having a minimum outer radial dimension and a maximum outer radial dimension, said contact surface contacting said spring at a position axially spaced from said maximum outer radial dimension of said spring.

34. The device of claim 33 wherein said spring extends around said piston rod.

35. The device of claim 33 wherein said contact surface comprises an annular element having a maximum axial dimension less than half the distance between the piston and the nearest cylinder end when the piston is in the neutral position.

36. The device of claim 33 wherein said spring includes a plurality of interengaged metal rings.

37. The device of claim 33 wherein said spring comprises a helical spring.

38. The device of claim 33 wherein said spring comprises an elastomer spring.

39. The device of claim 33 wherein said spring comprises a plurality of interengaged friction surfaces.

40. The device of claim 39 further comprising a second contact surface in contact with at least part of the spring, said second contact surface being in the cylinder and axially spaced from the first contact surface, said contact surfaces having a maximum axial spacing, the axial spacing between the contact surfaces decreasing when the piston moves toward the first end of the cylinder in response to a draft impact of sufficient magnitude.

41. The device of claim 33 wherein said spring is located between the piston and the first end of the cylinder.

42. A railcar cushioning device comprising a cylinder having a first end and a second end; a reservoir; flow passages communicating the cylinder and reservoir; pressurized hydraulic fluid in the cylinder and reservoir; a piston in the cylinder; a piston rod extending from said piston through the first end of the cylinder; said piston movable along the cylinder from a neutral position located between said cylinder ends toward each cylinder end in response to buff and draft impacts; and a spring in said cylinder, said spring located between said piston and one end of said cylinder to hold the piston in the neutral position against the pressure of the hydraulic fluid; a keeper comprising a pair of axially spaced contact surfaces and an elongate sleeve, one contact surface contacting one part of the spring and the other contact surface contacting another part of the spring, said keeper contact surfaces having a maximum axial spacing, the axial spacing between the keeper contact surfaces decreasing when the piston moves toward the first end of said cylinder in response to a draft impact of sufficient magnitude, said keeper contact surfaces being distinct from said piston, piston rod and cylinder, at least one of said contact surfaces being separate from said elongate sleeve and axially movable with respect to said elongate sleeve.

* * * * *